US008210873B2

(12) United States Patent
Chikusa

(10) Patent No.: US 8,210,873 B2
(45) Date of Patent: Jul. 3, 2012

(54) CONNECTOR

(75) Inventor: Takahiro Chikusa, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/959,675

(22) Filed: Dec. 3, 2010

(65) Prior Publication Data

US 2011/0143588 A1 Jun. 16, 2011

(30) Foreign Application Priority Data

Dec. 16, 2009 (JP) ..... 2009-285083

(51) Int. Cl.
*H01R 13/73* (2006.01)

(52) U.S. Cl. ..... 439/595

(58) Field of Classification Search ..... 439/595
See application file for complete search history.

(56) References Cited

U.S. PATENT DOCUMENTS

| | | | | |
|---|---|---|---|---|
| 6,322,391 | B1 | 11/2001 | Kodama | |
| 7,695,315 | B2 * | 4/2010 | Hitchcock et al. | 439/541.5 |
| 2001/0002347 | A1 | 5/2001 | Yoshida et al. | |
| 2005/0095909 | A1 | 5/2005 | Fukatsu | |

FOREIGN PATENT DOCUMENTS

JP 2009-231077 10/2009

* cited by examiner

*Primary Examiner* — Phuong Dinh
(74) *Attorney, Agent, or Firm* — Gerald E. Hespos; Michael J. Porco

(57) ABSTRACT

A waterproof connector has a deformation space (35) for a locking lance (30) that opens in the front surface of a housing (10). A wall surface (41) of a base end part of the locking lance (30) is located at a back side of the deformation space (35). In the process of inserting a terminal fitting (90) into a cavity (26), the locking lance (30) is resiliently deformed toward the deformation space (35) with a base end thereof as a support. When the terminal fitting (90) is inserted properly into the cavity (26), the locking lance (30) resiliently returns to retain the terminal fitting (90) in the cavity (26). A recess (42) is formed in the wall surface (41) of the base end portion of the locking lance (30).

12 Claims, 9 Drawing Sheets

CONNECTOR

BACKGROUND OF THE INVENTION

1. Field of the Invention

The invention relates to a connector.

2. Description of the Related Art

Japanese Unexamined Patent Publication No. 2009-231077 discloses a conventional connector with a housing formed with a cavity. A resiliently deformable locking lance projecting forward from an inner surface of the cavity and deformation space for the locking lance forms an opening in the front surface of the housing. A wall surface of a base end part of the locking lance is located at a back side of the deformation space.

A terminal fitting is inserted into the cavity of the housing from behind. The terminal fitting interferes with the locking lance during the inserting process and deforms the locking lance resiliently toward the deformation space with the base end of the locking lance as a support. The locking lance resiliently returns to lock the terminal fitting when the terminal fitting is inserted properly.

The above-described conventional connector is not a waterproof connector and no sealing member is mounted in the housing. Thus, there is a possibility that water will enter the cavity. Connection reliability may be reduced if water should deposit on the terminal fitting. Of course, a specified waterproof property can be obtained if a sealing member is mounted in the housing. However, the sealing member leads to a cost increase and simple a waterproof structure is hoped for.

The invention was developed in view of the above situation and an object thereof is to provide a connector with a simple waterproof structure.

SUMMARY OF THE INVENTION

The invention relates to a connector that has a housing with at least one cavity for receiving at least one terminal fitting. The housing has at least one resiliently deformable locking lance that projects from an inner surface of the cavity. The housing also has at least one deformation space for the locking lance. The deformation space forms an opening in an outer surface of the housing. A wall surface of a base end part of the locking lance is located at a back side of the deformation space. The locking lance deforms toward the deformation space with a base end thereof as a support in the process of inserting the terminal fitting into the cavity and resiliently restores to retain the terminal fitting in the cavity when the terminal fitting is inserted properly. At least one recess is formed in the wall surface of the base end part of the locking lance.

The wall surface of the base end part of the locking lance substantially faces the deformation space and the deformation space forms the opening in the outer surface of the housing. Thus, there is a possibility that water has entered the deformation space from the outer surface of the housing will run along the wall surface of the base end part of the locking lance to enter the cavity and deposit on the terminal fitting. However, the recess is formed in the wall surface of the base end of the locking lance. Thus, the water enters the recess to ensure a long creepage distance to the terminal fitting. As a result, the connector has a simple but effective waterproof structure.

The recess extends substantially in an inserting direction of the terminal fitting. Thus, the creepage distance becomes longer to improve a waterproof property.

The recess preferably is formed within the width of the locking lance. Thus, the base end part of the locking lance is not weakened and a smooth resilient deformation of the locking lance is assured.

A groove preferably is formed in the deformation space and extends over at least part of the length of the deformation space.

The groove preferably is formed upon forming a portion of the recess and is substantially continuous with the front end of the recess. More particularly, the groove preferably forms an opening in the front surface of the housing while cutting off a sloped portion of the deformation space.

One or more sloped portions preferably are formed at an opening edge of the cavity and/or at an opening edge of the deformation space in the front surface of the housing and gradually widened toward the front surface.

The housing preferably is formed with at least one side plate that at least partly partitions between the deformation space and the cavity located adjacent to it.

The terminal fitting preferably is supported by the side plate when the terminal fitting is inserted properly into the cavity.

A lance projection of the locking lance preferably fits into a locking hole of the terminal fitting or engages a rear end of a tubular portion of the terminal fitting when the terminal fitting is inserted properly into the cavity. Accordingly, the locking lance retains the terminal fitting in the cavity.

These and other objects, features and advantages of the invention will become more apparent upon reading of the following detailed description of preferred embodiments and accompanying drawings.

DETAILED DESCRIPTION OF THE PREFERRED EMBODIMENTS

A connector in accordance with the invention is illustrated in FIGS. 1 to 9. The illustrated connector is smaller than usual and includes a housing 10 that is connectable with a mating housing 60. In the following description, ends of two housings 10, 60 to be connected are referred to as front ends concerning forward and backward directions.

Figure 1:
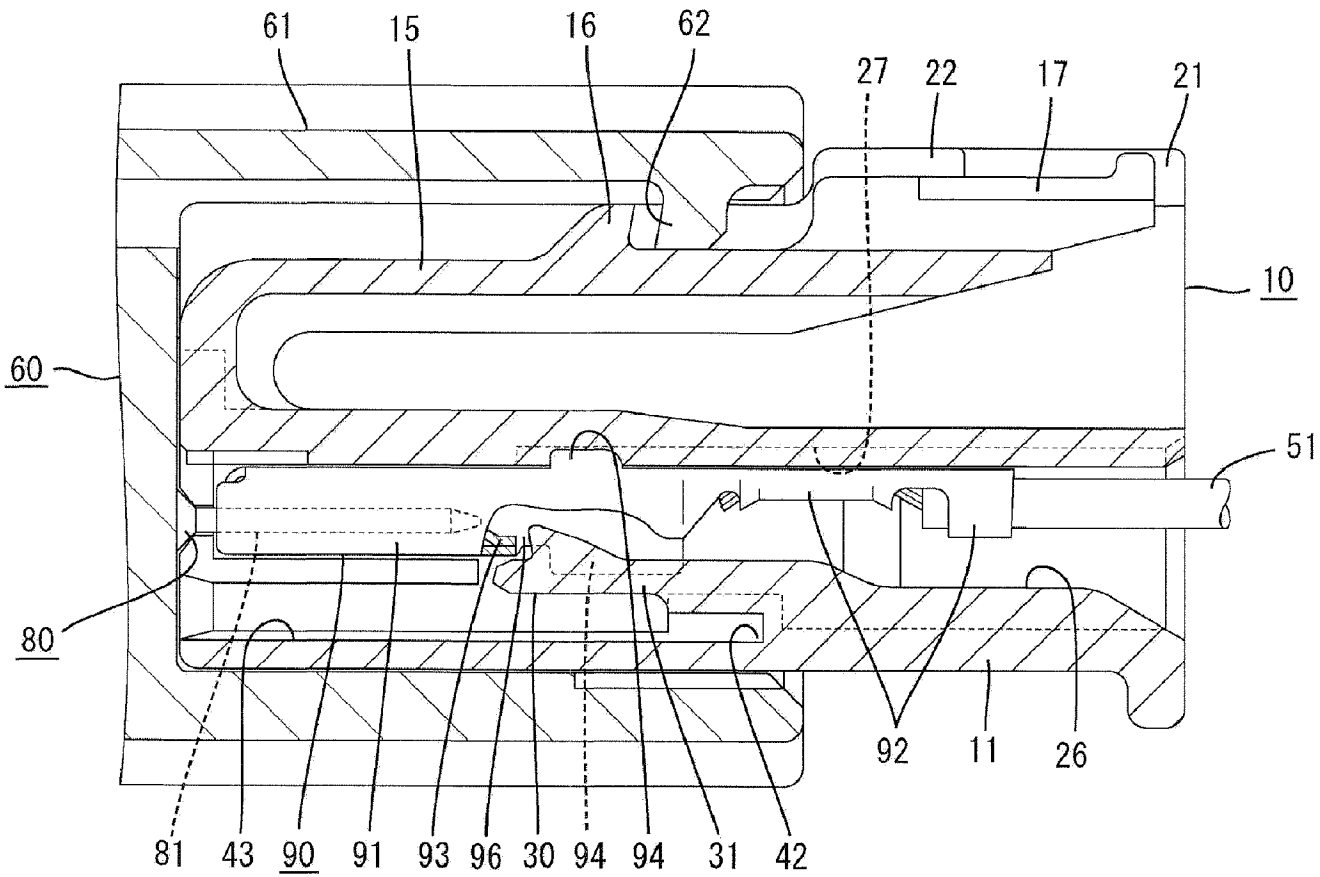
FIG. 1 is a section showing a state where a housing is properly connected with a mating housing in a connector according to one embodiment of the invention.

The mating housing 60 of the mating connector is made e.g. of synthetic resin. As shown in FIG. 1, the mating housing 60 has a substantially rectangular tubular receptacle 61, and tabs 81 of male terminal fittings 80 project into the receptacle 61. A mating lock 62 projects from the inner surface of the upper wall of the receptacle 61.

Figure 6:
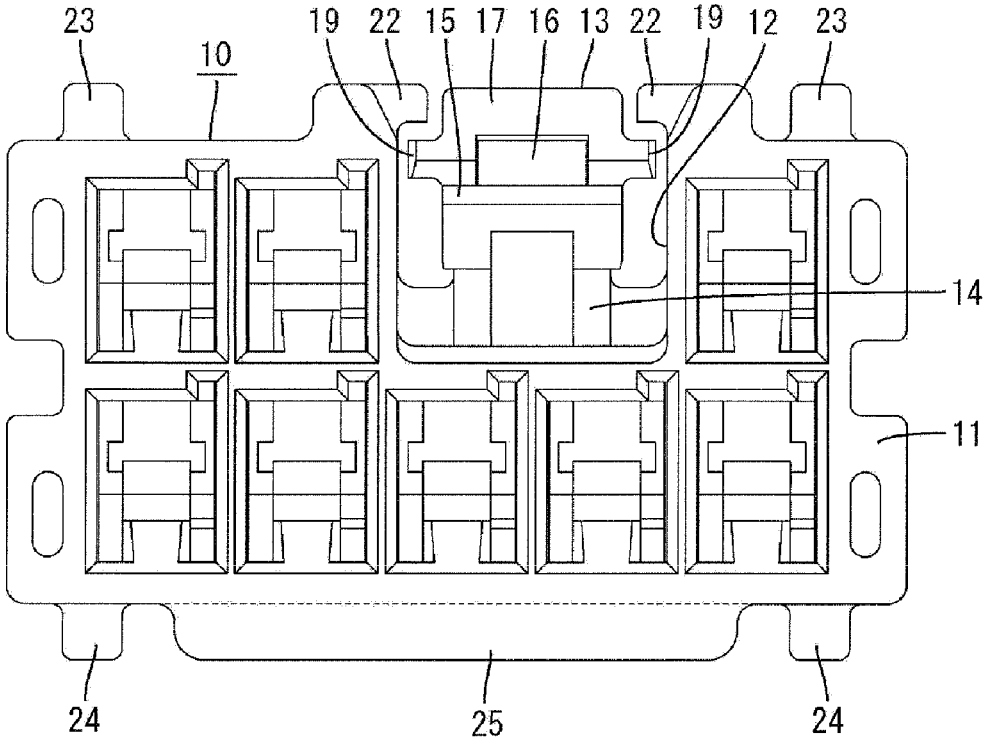
FIG. 6 is a rear view of the housing.
Figure 7:
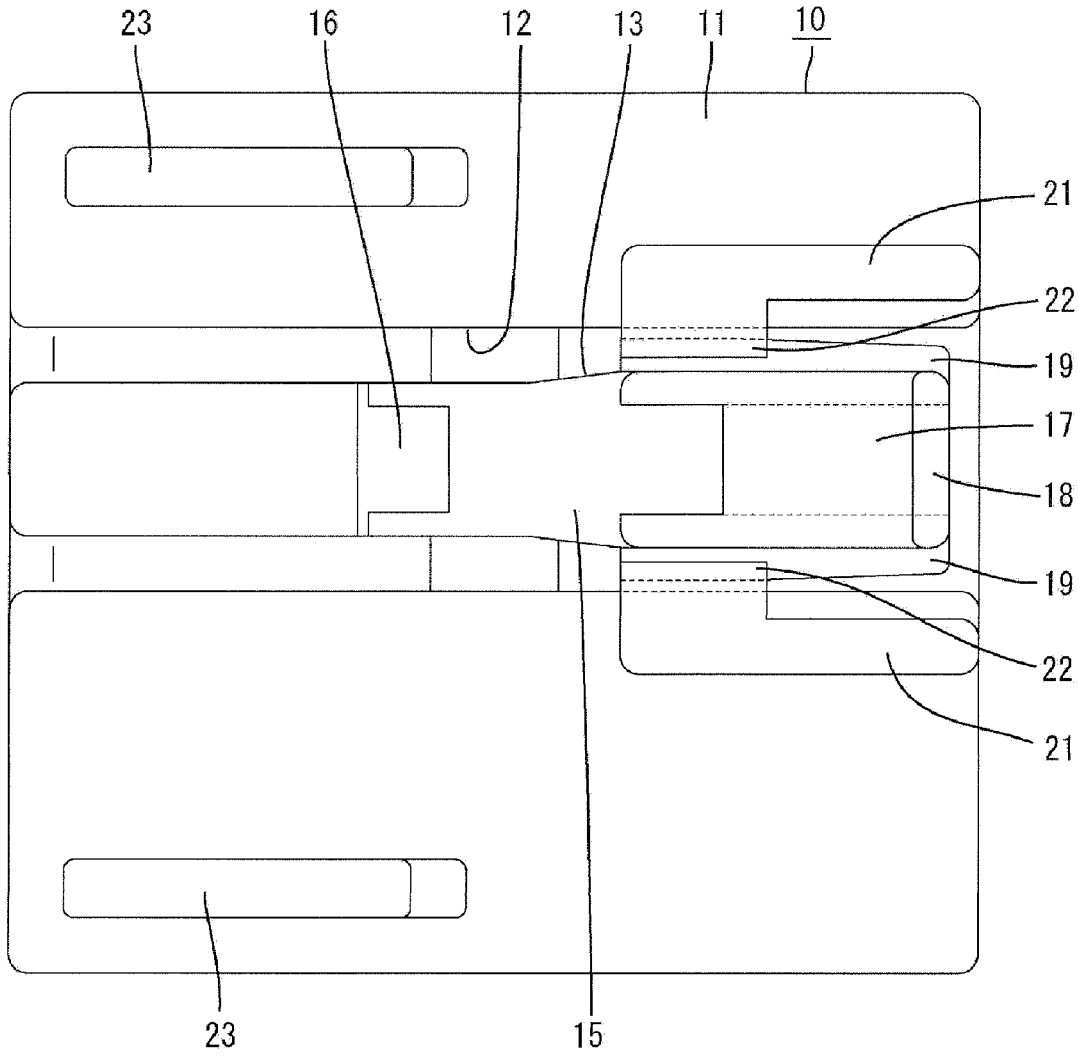
FIG. 7 is a plan view of the housing.
Figure 8:
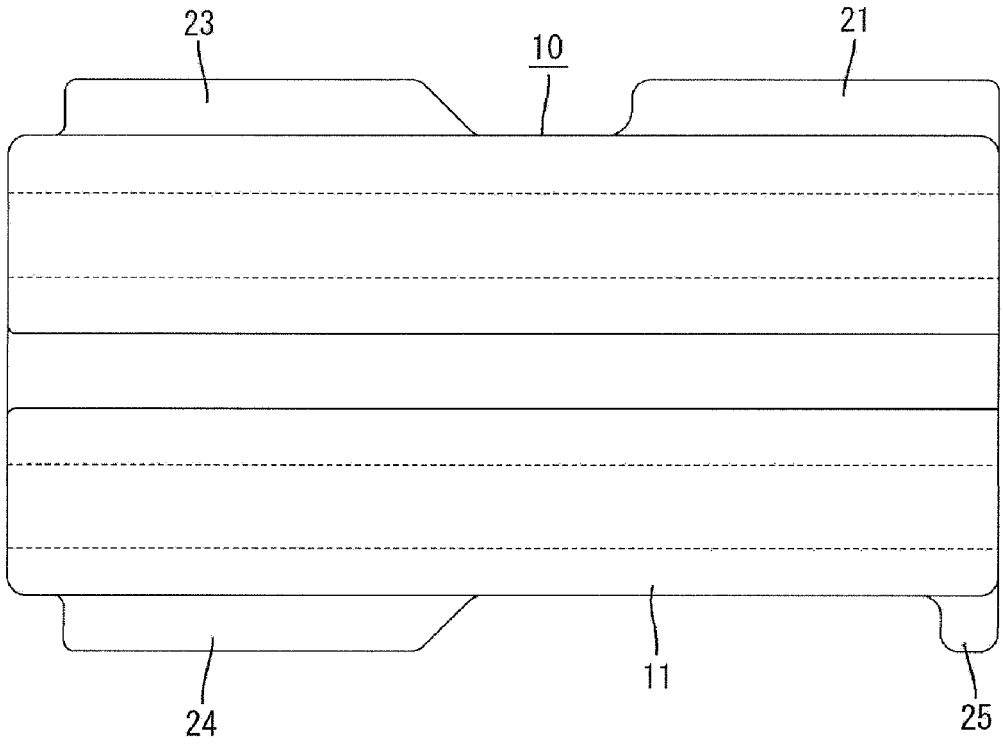
FIG. 8 is a side view of the housing.

The housing 10 is made e.g. of synthetic resin and has a substantially rectangular block-shaped main body 11. As shown in FIGS. 6 and 7, a groove 12 is formed in the upper surface of the main body 11 at a position displaced slightly toward one lateral side from the widthwise center. The groove 12 extends over substantially the entire length of the main body 11 in forward and backward directions and has a width less than 1 cm.

A lock arm 13 is arranged in the groove 12 of the main body 11. The lock arm 13 comprises a leg 14 and an arm 15. The leg 14 projects up and out from the front end of the bottom surface of the groove 12 and the arm 15 extends substantially horizontally back from the upper end of the leg 14. The rear end of the arm 15 reaches the vicinity of the rear end of the main body 11.

A lock 16 projects from the upper surface of the arm 15 at an intermediate position with respect to forward and backward directions. The upper end of the lock 16 is at the same height as or slightly lower than the upper surface of the main body 11 at opposite left and right sides of the groove 12. Thus, the lock 16 cannot be seen when viewed sideways.

The lock 16 and the mating lock 62 interfere in the process of connecting the two housings 10, 60. Thus, the arm 15 deforms down and in with the leg 14 as a support. The lock 16 engages the mating lock 62 from behind when the two housings 10, 60 are connected properly so that the two housings 10, 60 are held together.

Figure 2:
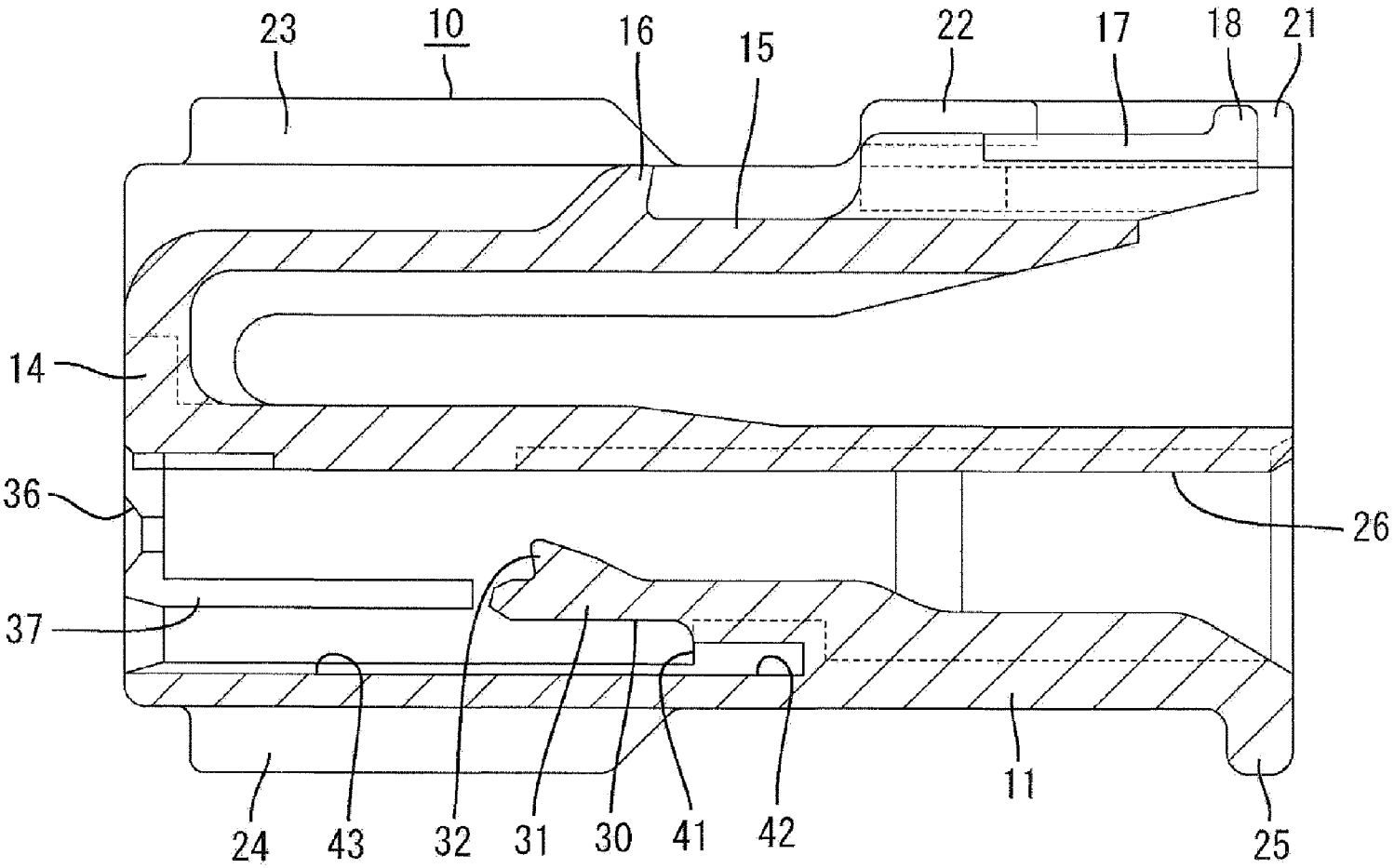
FIG. 2 is a section of a lock arm part of the housing.

As also shown in FIG. 2, an unlocking portion 17 is slightly raised at a rear end portion of the arm 15. An unlocking rib 18 is formed over substantially the entire width of the unlocking portion 17 near the rear end of the unlocking portion 17. Left and right bulges 19 are formed along the opposite lateral edges of the arm 15 at positions corresponding to the unlocking portion 17. Distances between the lateral edges of the bulges 19 and the side surfaces of the groove 12 are smaller than the outer diameters of wires 51 connected to terminal fittings 90 to ensure that the wires 51 are not jammed between them.

Left and right protecting walls 21 project at the opposite sides of the unlocking portion 17 at a rear end of the upper surface of the main body 11. Left and right restricting pieces 22 project in toward the lock arm 13 at the inner edges of front portions of the protecting walls 21. An excessive upward deformation of the arm 15 is restricted by the contact of the bulges 19 with the restricting pieces 22.

Upper surfaces of the protecting walls 21 are substantially flat and are higher than all of the unlocking portion 17 except the unlocking rib 18 and are at substantially the same height as the unlocking rib 18. An unlocking space is formed between the protecting walls 21 and above the upper surface of the unlocking portion 17 (excluding the unlocking rib 18). Upon separating the two housings 10, 60, a fingertip can be inserted into the unlocking space to press the arm 15 down while engaging the fingernail with the unlocking rib 18 to disengage the lock 16 from the mating lock 62 to effect unlocking.

Left and right upper guide projections 23 extend in forward and backward directions at opposite sides of the upper surface of the main body 11 for guiding insertion of the main body 11 into the receptacle 61. Front ends of the upper guide projections 23 are slightly behind the front end of the main body 11 and include vertical surfaces extending out in a vertical direction. The rear ends of the upper guide projections 23 are in a central part of the housing main body 11 with respect to forward and backward directions and have inclined surfaces sloped down toward the back. The entire upper surfaces of the upper guide projections 23 are substantially flat and are at substantially same height as the upper surfaces of the protecting walls 21. Thus, the housing 10 could be placed in a vertically inverted posture on a flat surface and supported horizontally by the protecting walls 21 and the upper guide projections 23 without being shaken.

Figure 9:
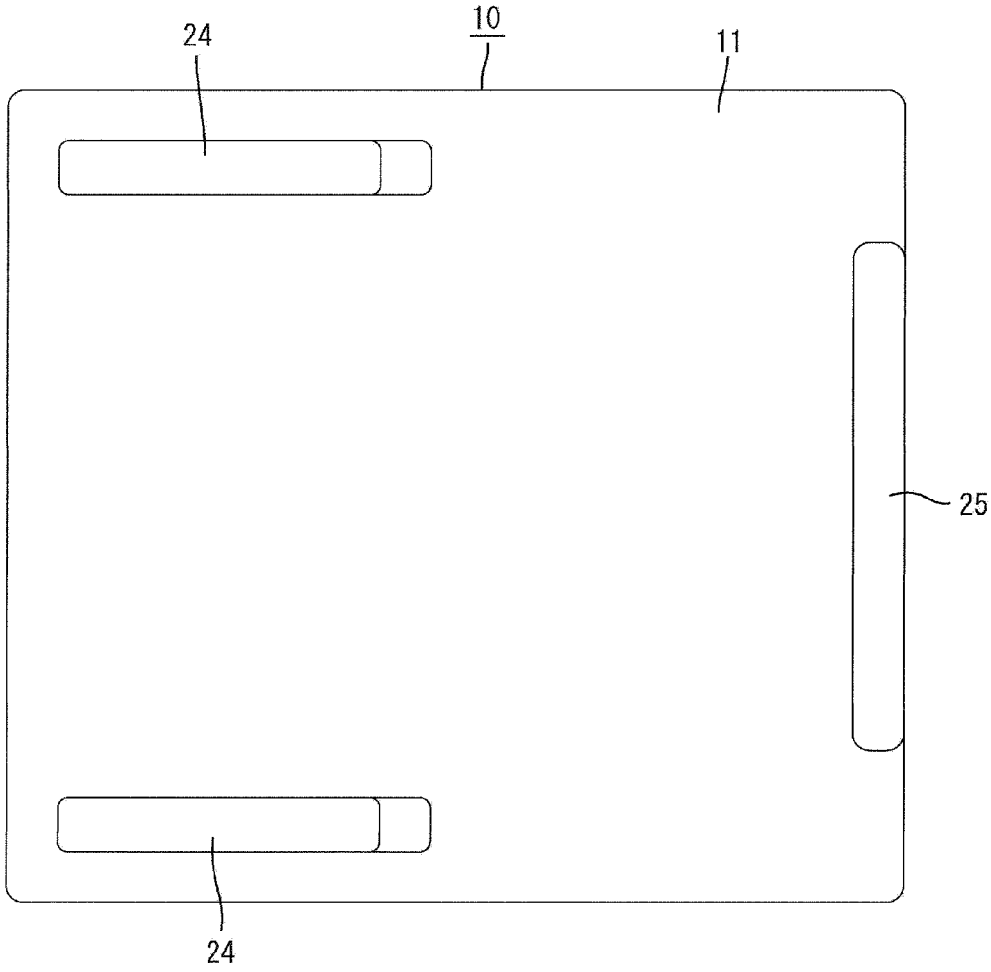
FIG. 9 is a bottom view of the housing.

Left and right lower guide projections 24 are formed at opposite sides of the lower surface of the main body 11, as shown in FIG. 9. The lower guide projections 24 have substantially the same size and shape as the upper guide projections 23 and are in a vertically symmetrical positional relationship with the upper guide projections 23. At least one lower rib 25 extends in a width direction at the rear end of the lower surface of the housing main body 11. The bottom end of the lower rib 25 is at substantially the same height as bottom ends of the lower guide projections 24. Thus, the lower rib 25 and the lower guide projections 24 can support the housing 10 horizontally on a horizontal surface without being shaken.

Cavities 26 penetrate the main body 11 in forward and backward directions. The cavities 26 are arranged in upper and lower levels. The cavities 26 in the upper level are divided at the opposite left and right sides of the groove 12. The terminal fittings 90 are to be inserted into the respective cavities 26 from behind.

Each terminal fitting 90 is formed unitarily by applying bending, folding and/or embossing to an electrically conductive metal plate and includes a rectangular tubular box portion 91 and an open barrel 92 continuous with and behind the box portion 91. The barrel 92 is crimped into connection with an end of the wire 51. As the two housings 10, 60 are connected, the tabs 81 are to be inserted into the tubular box portions 91 from the front and the properly inserted tabs 81 contact resilient contact pieces 93 resiliently deformably formed in the tubular box portions 91 to connect the terminal fittings 80, 90.

Upper and lower stabilizers 94 are formed to project adjacent to and at a rear end of the box portion 91. Upper and lower guiding grooves 27 are formed substantially along each cavity 26 in the main body 11, and the stabilizers 94 are to be inserted slidably into the respective guiding grooves 27. The stabilizers 94 guide the insertion of the terminal fitting 90 into the cavity 26 and prevent erroneous insertion of the terminal fitting 90 into the cavity 26. Further, the tubular box portion 91 has a locking hole 96 engageable with a locking lance 30 by cutting and bending the stabilizer 94. Alternatively, the locking lance 30 may engage a rear portion of the tubular box portion 91 for locking purposes.

Figure 3:
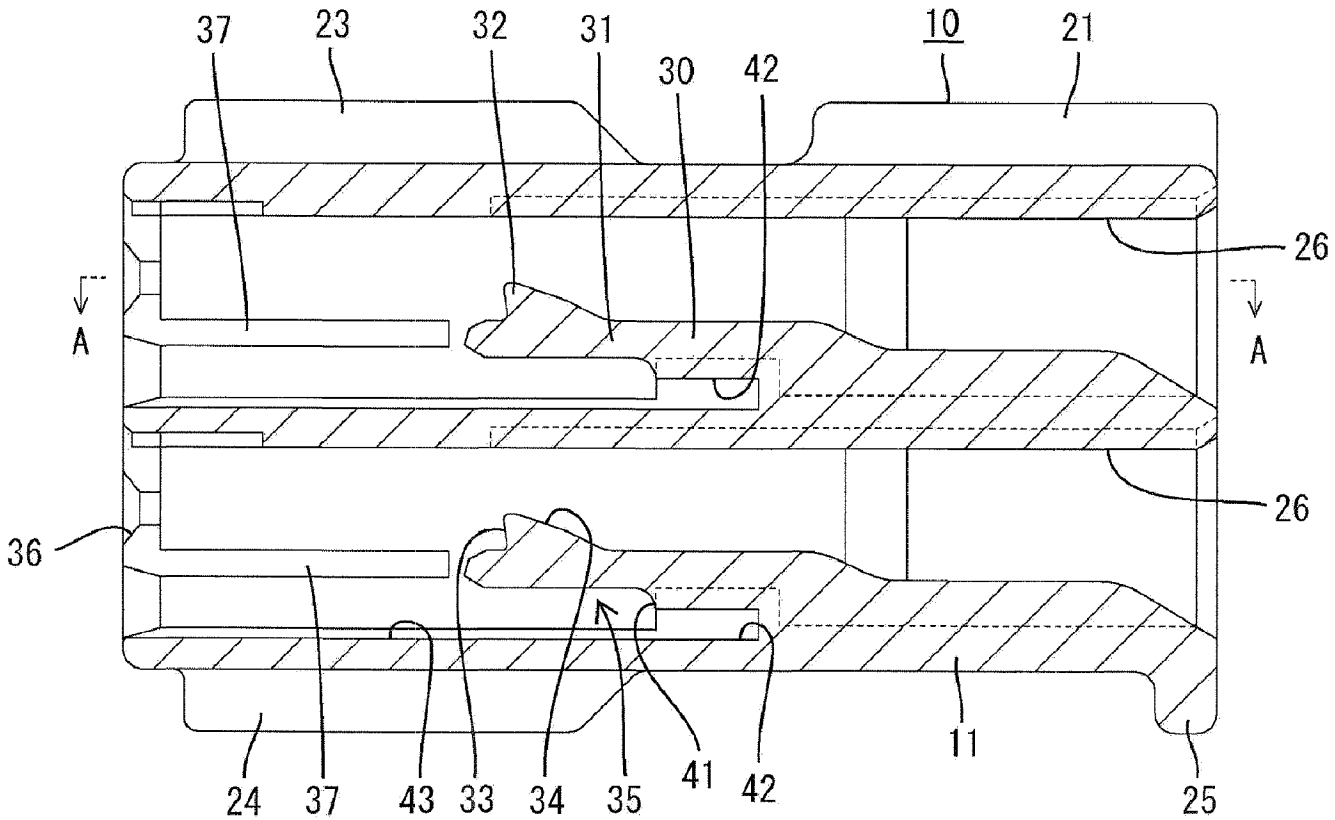
FIG. 3 is a section of the housing at a position near a widthwise end.
Figure 4:
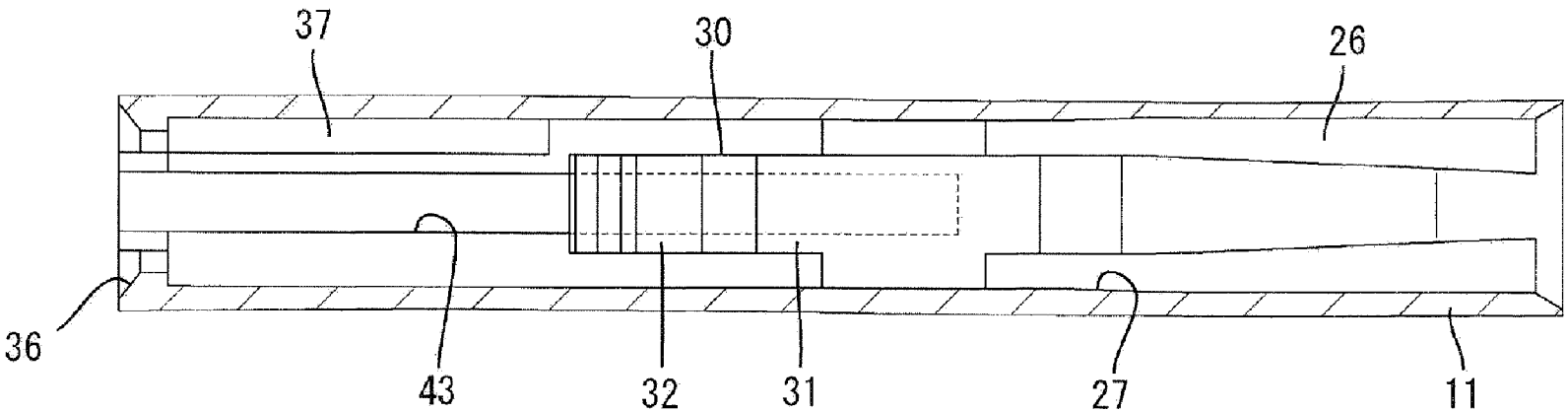
FIG. 4 is a section along A-A of FIG. 3.

The resiliently deformable locking lance 30 is formed at an inner surface of each cavity 26 in the housing main body 11. As shown in FIG. 3, each locking lance 30 has a lance main body 31 that is cantilevered forward from a thickened intermediate part of the lower wall of the cavity 26 with respect to forward and backward directions. A lance projection 32 projects from an upper surface of the lance main body 31 near the front end of the lance main body 31. The lower guiding groove 27 extends in forward and backward directions at one lateral edge of a base end part of the lance main body 31. A forwardly overhanging locking surface 33 is defined at the front end of the lance projection 32 and is engageable with the front edge of the locking hole 96 in the box portion 91 or with a rear edge of the box portion 91. A guiding slope 34 is formed at the rear of the lance projection 32 and inclines up and toward the front so that the terminal fitting 90 slides on the guiding slope 34 during insertion into the cavity 26.

Figure 5:
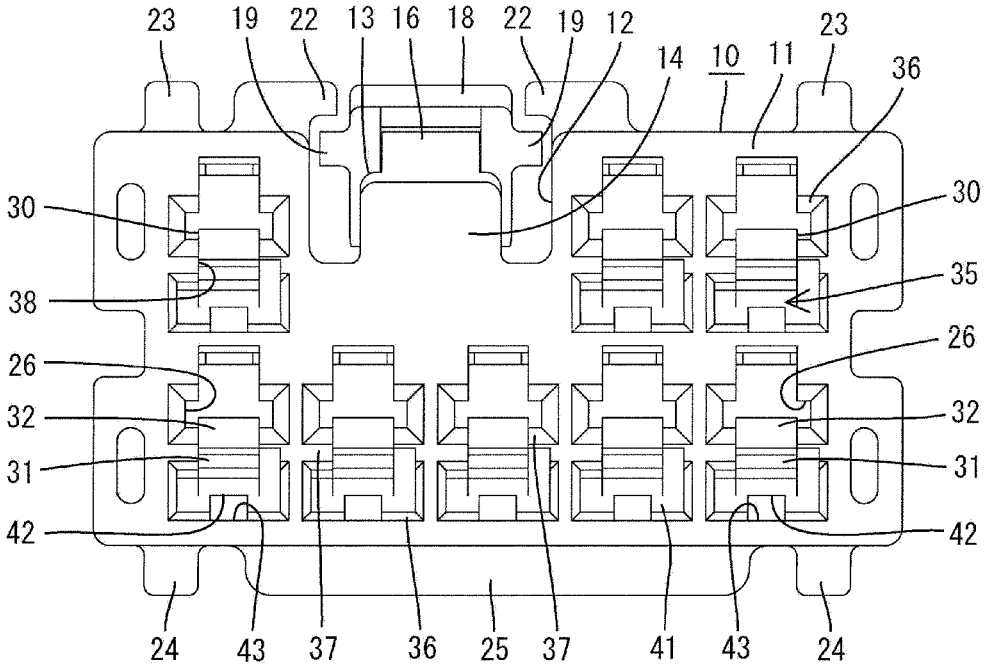
FIG. 5 is a front view of the housing.

A front portion of the lower inner surface of each cavity 26 is slightly lower than a rear portion thereof, thereby forming a deformation space 35 for the locking lance 30 between this lowered inner surface and a leading end portion of the lower surface of the lance main body 31. The deformation space 35 opens in the front surface of the housing main body 11. As shown in FIG. 5, slopes 36 are formed at the front opening edges of the cavities 26 and the front opening edges of the deformation spaces 35 and gradually widened toward the front in the front surface of the housing main body 11.

Left and right side plates 37 are formed on the main body 11 and partition the deformation space 35 and the cavity 26 located thereabove. Opposite widthwise ends of the lower surface of the box portion 91 are supported from below by the side plates 37 when the terminal fitting 90 is inserted properly inserted into the cavity 26. More particularly, a mold removal hole 38 is formed between the side plates 37 by removal of a mold for forming the front ends of the lance main body 31 and the lance projection 32. The mold removal hole 38 forms an opening in the front surface of the housing main body 11 and permits the cavity 26 and the deformation space 35 to communicate vertically.

A vertical surface 41 is formed at the base end of the locking lance 30 and is substantially continuous with the lower surface of the lance main body 31 so that the vertical surface 41 faces the deformation space 35. A long narrow substantially rectangular recess 42 extends back into a lower part of the vertical surface 41 and is within width and length ranges of the locking lance 30. The rear end of the recess 42 is located before the front ends of the lower guiding grooves 27.

A shallow groove 43 is formed in the lower surface of each deformation space 35 in the housing main body 11 and extends over substantially the entire length of the deformation space 35. The groove 43 is formed when forming a bottom end portion of the recess 42. Thus, the groove 43 is substantially continuous with the front end of the recess 42 and opens in the front surface of the housing main body 11 while cutting off the slope 36 of the deformation space 35. The recess 42 prevents a sink of the base end part of the thickened locking lance 30.

The terminal fitting 90 is inserted into the cavity 26 of the housing 10 from behind. In the inserting process, the box portion 91 of the terminal fitting 90 slides on the guiding slope 34 of the lance projection 32 and the lance main body 31 is deformed toward the deformation space 35 with the base end thereof as a supporting. The lance main body 31 resiliently returns when the terminal fitting 90 is inserted properly into the cavity 26. Thus, the lance projection 32 fits into the locking hole 96 or engages a rear portion of the box portion 91 to retain the terminal fitting 90 in the cavity 26.

Subsequently, the two housings 10, 60 are held opposite to each other and are connected with each other in this state. When the two housings 10, 60 are connected properly, the lock projection 16 of the lock arm 13 engages the lock portion 62, as shown in FIG. 1, to hold the two housings 10, 60 in a connected state. Additionally, the tabs 81 are inserted to proper depths into the box portions 91 to electrically connect the terminal fittings 80, 90. In the process of connecting the two housings 10, 60, the housing 10 can be inserted into the receptacle 61 of the mating housing 60 while the protecting portions 21 and the lower rib 25 are gripped by fingers. The front ends of the protecting portions 21 are near the front end of the receptacle 61 when the housings 10, 60 are connected properly.

This connector is a non-waterproof connector and has no sealing member. However, water may run between front connection surfaces of the housings 10, 60 to enter the cavities 26 of the housing 10 and deposit on the terminal fittings 90 when the housings 10 60 are connected. However, according to this embodiment, even if water enters the deformation space 35 along the connection surfaces of the housings 10, 60, the water must go through the recess 42 to reach the terminal fitting 90 after entering the recess 42 from the groove 43. Therefore, a creepage distance to the terminal fitting 90 becomes longer and a simple waterproof structure of the connector can be realized.

The recess 42 extends substantially in forward and backward directions as an inserting direction of the terminal fitting 90. Thus, the creepage distance becomes even longer to improve a waterproof property. Further, the recess 42 is formed within the width range of the locking lance 30 so that the locking lance 30 is not weakened to ensure a smooth resilient deformation of the locking lance 30.

The invention is not limited to the above described and illustrated embodiment. For example, the following embodiments also are included in the scope of the invention.

The recesses may be formed between adjacent locking lances.

The recesses may have other shapes, e.g. a circular cross sectional shape.

A retainer (front retainer, side retainer or back retainer) may be mounted in the housing and the terminal fittings may be locked doubly by the retainer and the locking lances.

The invention also is applicable to waterproof connectors with a sealing member is mounted in a housing.

What is claimed is:

1. A connector, comprising:

a housing with at least one cavity for receiving at least one terminal fitting;

at least one resiliently deformable locking lance projecting from an inner surface of the cavity, the locking lance being deformed toward the deformation space with a base end thereof as a support in the process of inserting the terminal fitting into the cavity and returning resiliently to retain the terminal fitting in the cavity when the terminal fitting is inserted properly into the cavity;

at least one deformation space for the locking lance opening in an outer surface of the housing, a surface of a base end part of the locking lance being located at a back side of the deformation space;

at least one recess being formed in a surface of the base end part of the locking lance; and a groove formed in the deformation space and extending over substantially an entire length of the deformation space.

2. The connector of claim 1, wherein the recess extends substantially in an inserting direction of the terminal fitting.

3. The connector of claim 2, wherein the recess is formed within a width of the locking lance.

4. The connector of claim 1, wherein the groove is continuous with the front end of the recess, and opens in the front surface of the housing.

5. The connector of claim 1, wherein at least one slope gradually widened toward the front surface is formed at an opening edge portion of the cavity or at an opening edge of the deformation space and widens gradually toward a front surface of the housing.

6. The connector of claim 1, wherein the housing has at least one side plate that at least partly partitions between the deformation space and the cavity adjacent to the side plate.

7. The connector of claim 6, wherein, when the side plate supports the terminal fitting that has been inserted properly into the cavity.

8. The connector of claim 1, wherein, when the terminal fitting is inserted properly into the cavity, a lance projection of the locking lance is fit into a locking hole of the terminal fitting or engages a rear portion of the terminal fitting to retain the terminal fitting in the cavity.

9. A connector, comprising:

a housing with opposite front and rear ends and a cavity extending through the housing from the front end to the rear end for receiving a terminal fitting;

a resiliently deformable locking lance cantilevered forwardly from an inner surface of the cavity;

a deformation space for the locking lance opening at the front end of the housing and accommodating deformation of the locking lance, the deformation space having a lower surface facing the locking lance and a forwardly facing surface facing the front end of the housing;

a recess formed in the forwardly facing surface for increasing a creepage distance for moisture from exterior regions to the cavity; and a groove formed in the lower surface of the deformation space facing the locking lance and extends from the front end of the housing to the forwardly facing surface.

10. The connector of claim 9, wherein the recess extends substantially parallel to a direction extending from the front end to the rear end.

11. The connector of claim 2, wherein a width of the recess is within a range defined by a width of the locking lance.

12. The connector of claim 9, wherein the groove is continuous with the front end of the recess.

* * * * *